United States Patent [19]

Azzolini

[11] 4,043,712

[45] Aug. 23, 1977

[54] ADJUSTABLE ROLLER PUMP ASSEMBLY

[75] Inventor: Graziano Azzolini, Cavezzo - MO., Italy

[73] Assignee: Sandoz Ltd., Basel, Switzerland

[21] Appl. No.: 643,678

[22] Filed: Dec. 23, 1975

[30] Foreign Application Priority Data

Dec. 17, 1975 Italy ..... 28990/75

[51] Int. Cl.[2] ..... F04B 43/08; F04B 43/12; F04B 45/06

[52] U.S. Cl. ..... 417/477

[58] Field of Search ..... 417/477, 476; 128/214 F, DIG. 3; 74/242.8, 29, 22 A, 242.12; 92/13.2; 418/45; 222/214

[56] References Cited

U.S. PATENT DOCUMENTS

| | | | |
|---|---|---|---|
| 460,944 | 10/1891 | Burson | 417/477 |
| 2,046,917 | 7/1936 | Kingsbury | 74/242.8 |
| 3,700,361 | 10/1972 | De Vries | 417/477 |

FOREIGN PATENT DOCUMENTS

| | | | |
|---|---|---|---|
| 628,785 | 9/1949 | United Kingdom | 417/477 |

*Primary Examiner*—Carlton R. Croyle
*Assistant Examiner*—Thomas I. Ross
*Attorney, Agent, or Firm*—Gerald D. Sharkin; Robert S. Honor; Walter F. Jewell

[57] ABSTRACT

The invention concerns a novel adjustable roller pump assembly of the type comprising a semi-circular plate against the inner surface of which a flexible tube is located and a pair of diametrically arranged cylindrical rollers mounted on a driven rotatable body. The invention is related to a special means for adjusting the distance between the axes of the rollers so that the degree which the rollers compress the flexible tube can be adjusted. This means comprises an adjustment shaft rotatable about an axis transverse of the axis of rotation of the rotatable body and having at its ends cylindrical locating elements eccentric to the axis of rotation of the adjustment shaft, said locating elements acting on arms on which rollers are mounted so that adjustment of the adjustment shaft displaces the arms and hence the rollers.

2 Claims, 2 Drawing Figures

ADJUSTABLE ROLLER PUMP ASSEMBLY

Figure 1:
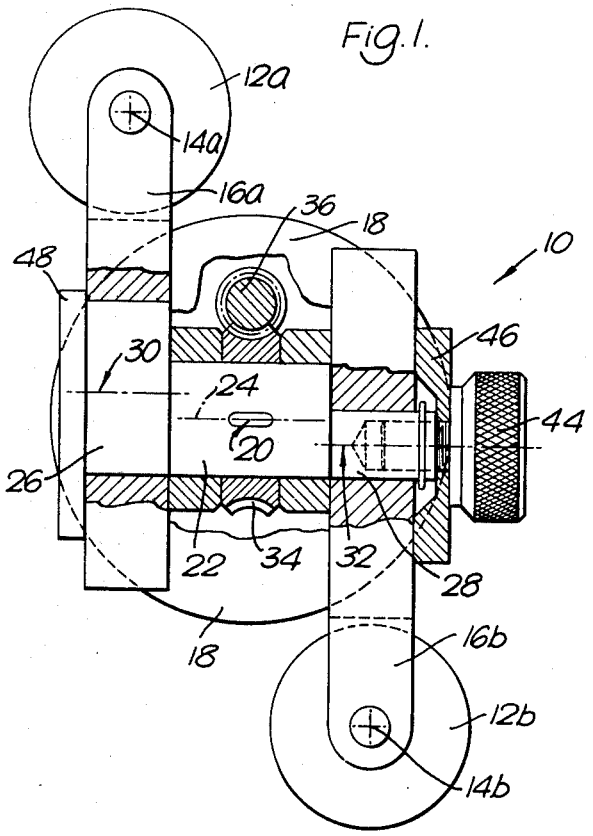

This invention relates to an adjustable roller pump assembly. More particularly, the invention concerns a means whereby the distance between the axes of a pair of rollers of the roller pump assembly may be adjusted so that their compressing action on a flexible tube on which they act in performing conventional roller pumping can be adjusted.

Roller pumps are well known, particularly in the medical field where they are regularly employed for pumping blood through extracorporeal blood lines. A roller pump of the type with which the present invention is concerned conventionally comprises a semi-circular plate against the inner surface of which a flexible tube is located, and a pair of diametrically arranged cylindrical rollers mounted on a driven rotatable body. In operation, one of the rollers compresses the flexible tube against the semi-circular plate as it proceeds over the inner surface of the semi-circular plate for half of the cycle of rotation of the rotatable body and the other roller then compresses the flexible tube in the same manner for the other half of the cycle of rotation. In this manner, fluid leading to the flexible tube is continuously forced through the flexible tube by one or other of the rollers as it proceeds along the flexible tube over the inner surface of the semi-circular plate.

The rate of rotation of the rotatable body and hence the rollers is normally adjustable so that pumping rate can be adjusted. However, the pumping rate can also be adjusted by adjusting the degree which the rollers compress the flexible tube. This can be done in roller pump assemblies provided with adjustment means for adjusting the distance between the axes of the rollers and hence the distance between the roller surfaces and the inner surface of the semi-circular plate. Another and important reason for roller pumps to be adjustable in this fashion is that the compressibility, size and other qualities of the flexible tube can vary considerably.

The roller pump assembly of the present invention is concerned with one which is provided with a special means for adjusting the distance between the axes of the rollers, this means enabling manual adjustment by rotation of a single element with one hand, even while the pump is in operation.

In accordance with the invention, there is provided an adjustable roller pump assembly, comprising a pair of cylindrical rollers, a pair of arms at the end of which one of the pair of cylindrical rollers is rotatably mounted for rotation about their axes, a body rotatable about an axis in which the pair of arms are slideably mounted, the axes of the cylindrical rollers being parallel to and diametrically spaced away from the axis about which the body is rotatable so that sliding of the arms in the rotatable body adjusts the distance between the axes of the rollers, an adjustment shaft rotatably mounted in the body with its axis of rotation transverse to the axis about which the body is rotatable and carrying at each end a cylindrical locating element rotatable with rotation of the adjustment shaft, the axis of the cylindrical locating element at one end of the adjustment shaft being eccentric to one side of the adjustment shaft axis of rotation, and the axis of the cylindrical locating element at the other end of the shaft being equally eccentric to the other side of the adjustment shaft axis of rotation, the arms on which the rollers are mounted each being provided with a flattened cylindrical opening into which the cylindrical locating elements fit rotatably so that the axes of the rollers are equidistant from the axis of rotation of the body; whereby rotation of the adjustment shaft and locating elements causes displacement of the arms and corresponding displacement of the rollers.

The adjustment shaft may be provided with a toothed gear coaxial with the axis of rotation of the adjustment shaft, a threaded screw engaging with the toothed gear and having a head for manual rotation of the screw and hence rotation of the adjustment shaft then being provided.

A handle mounted on the body may be provided for manually rotating the body, arms and rollers about axis of rotation of the body.

The invention will now be described with reference to the accompanying drawings showing, by way of example only, one construction of an adjustable roller pump assembly in accordance with the invention.

Figure 2:
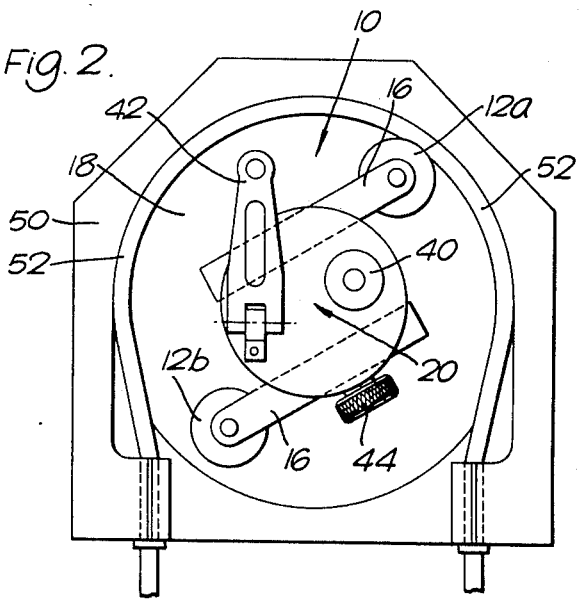

In the drawings:

FIG. 1 shows a part cross-sectional plan view of an adjustable roller pump assembly, without associated conventional parts; and FIG. 2 shows a diminished plan view of FIG. 1, with associated conventional parts.

Referring to FIGS. 1 and 2 of the drawings, reference numeral 10 refers generally to an adjustable roller pump assembly which comprises a pair of cylindrical rollers **12*a* and 12*b* rotatably mounted for rotation about their axes 14*a* and 14*b* respectively at the end of a pair of arms 16*a* and 16*b*. A circular body 18 rotatable about its central axis 20 by means of drive means (not shown) is provided, in which the pair of arms 16*a* and 16*b*** are slideably mounted.

The axes **14*a* and 14*b* of the cylindrical rollers 12*a* and 12*b* are parallel to and diametrically spaced away from the axis 20 about which the body 18 is rotatable. Sliding of the arms 16*a* and 16*b* in the rotatable body 18 obviously adjusts the distance between the axes 14*a* and 14*b* of the rollers. Alternatively stated, for example, displacement of arms 16*a* and 16*b* outwardly from the body will increase the distance between the axis of each roller and the axis 20 about which the rotatable body 18** is rotatable.

An adjustment shaft 22 is rotatably mounted in the body 18 with its axis of rotation 24 transverse to the axis 20 about which the body 18 is rotatable. At each end of the adjustment shaft 22, a cylindrical locating element is provided, the locating element at the left hand side of FIG. 1 being referred to by reference numeral 26 and that at the right hand side of FIG. 1 by reference numeral 28. The cylindrical locating elements 26 and 28 are integral with adjustment shaft 22 and thus rotatable with rotation of the adjustment shaft.

As can readily be seen from FIG. 1, the cylindrical locating element 26 is larger than the cylindrical locating element 28, and the axis 30 of the cylindrical locating element 26 is eccentric to one side of the adjustment shaft axis of rotation 24, and the axis 32 of the cylindrical locating element 28 is equally eccentric to the other side of the adjustment shaft axis of rotation 24.

The arms **16*a* and 16*b* are respectively each provided with a flattened cylindrical opening corresponding in size to the cylindrical locating elements 26 and 28, so that the locating elements fit into such elements rotatably. The positionings of the openings in the arms 16*a* and 16*b* are such that the axes of the rollers 14*a* and 14*b* are equidistant from the axis of rotation 20 of the body 18. The adjustment shaft 22 is provided with a toothed gear 34 coaxial with the axis of rotation 24 of the adjustment shaft 22, a threaded screw 36 engaging with the toothed gear 34 and having a head 40 (see FIG. 2) for manual rotation of the screw and hence rotation of the adjustment shaft 22** then being provided.

Referring to FIG. 2, a handle 42 is hingedly mounted on the body 18 whereby the body, the arms and rollers may be manually rotated about the axis of rotation 20 of the body.

A locking screw 44 mates with a threaded bore provided in the locating element 28 and the flange of the locking screw abuts against a flattened section 46 of the body 18 so that tightening of the locking screw locks the locating element 28 and hence also the adjustment shaft 22 and locating element 26 against rotation about the axis of rotation 24. An abutment plate 48 abutting against the one side of the arm 16*a* is provided so that tightening of screw 44, will cause the abutment place 48 to press against the side of the arm 16*a* and hence achieve tight location thereof in the body 18.

Referring again to FIG. 2 of the drawings, a semi-circular surface is defined by pump housing component 50. A flexible tube 52 is mounted against said semi-circular surface so that in operation of the roller pump, one of the rollers 12*a* or 12*b* compresses the flexible tube 52 against the semi-circular surface as it proceeds over the semi-circular surface. It will be appreciated from FIG. 2 that the one roller compresses the flexible tube for approximately half of the cycle of rotation of the rotatable body 18 and the other roller will then compress the flexible tube in the same manner for the other half of the cycle.

I claim:

1. An adjustable roller pump assembly, comprising a pair of cylindrical rollers, a pair of arms at the end of which one of the pair of cylindrical rollers is rotatably mounted for rotation about their axis, a body rotatable about an axis in which the pair of arms are slideably mounted, the axes of the cylindrical rollers being parallel to and diametrically spaced away from the axis about which the body is rotatable so that sliding of the arms in the rotatable body adjusts the distance between the axes of the rollers, an adjustment shaft rotatably mounted in the body with its axis of rotation transverse to the axis about which the body is rotatable and carrying at each end a cylindrical locating element rotatable with rotation of the adjustment shaft, the axis of the cylindrical locating element at one end of the adjustment shaft being eccentric to one side of the adjustment shaft axis of rotation, and the axis of the cylindrical locating element at the other end of the shaft being equally eccentric to the other side of the adjustment shaft axis of rotation, the arms on which the rollers are mounted each being provided with a flattened cylindrical opening into which the cylindrical locating elements fit rotatably so that the axes of the rollers are equidistant from the axis of rotation of the body; whereby rotation of the adjustment shaft and locating elements causes displacement of the arms and corresponding displacement of the rollers.

2. An adjustable roller pump assembly according to claim 1, in which the adjustment shaft is provided with a toothed gear coaxial with the axis of rotation of the adjustment shaft, a threaded screw engaging with the toothed gear and having a head for manual rotation of the screw and hence rotation of the adjustment shaft then being provided.

* * * * *